US005507630A

United States Patent [19]

Hegebarth

[11] Patent Number: 5,507,630

[45] Date of Patent: Apr. 16, 1996

[54] QUICK RELEASE INTERCHANGEABLE VALVE ARRANGEMENT FOR SLURRY PUMP SYSTEMS

[75] Inventor: Donald C. Hegebarth, Naperville, Ill.

[73] Assignee: Chemgrout, Inc., LaGrange Park, Ill.

[21] Appl. No.: 410,814

[22] Filed: Mar. 27, 1995

[51] Int. Cl.[6] ..... F04B 53/22; F04B 15/02; F04B 23/06

[52] U.S. Cl. ..... 417/454; 417/538; 417/568; 417/900; 137/269.5; 137/271

[58] Field of Search ..... 417/454, 538, 417/568, 900; 137/269.5, 271, 270; 92/151

[56] References Cited

U.S. PATENT DOCUMENTS

| | | | |
|---|---|---|---|
| 1,331,504 | 2/1920 | Hewitt | 417/538 |
| 1,548,981 | 8/1925 | Clark | 417/538 |
| 1,606,868 | 11/1926 | Chase | 417/538 |
| 1,832,664 | 11/1931 | Smoak | 417/538 |
| 2,331,070 | 10/1943 | Farque | 417/454 |
| 4,526,520 | 7/1985 | Henderson . | |
| 4,623,303 | 11/1986 | Henderson | 417/454 |
| 4,746,278 | 5/1988 | Henderson | 417/454 |
| 4,826,046 | 5/1989 | Rudick | 417/538 |
| 5,282,724 | 2/1994 | Reynolds | 417/454 |

FOREIGN PATENT DOCUMENTS 1215579 12/1966 Canada .

OTHER PUBLICATIONS

Brochure entitled "The 'Halfyard' Simplex, Horizontal Plunger, Injection Pump", published by James K. Henderson, 1992.

Brochure entitled "Sempione 12.12 Grout Injection and Transfer Pumps", published by F. Peroni & Co., 1986.

*Primary Examiner*—Richard A. Bertsch
*Assistant Examiner*—Roland G. McAndrews, Jr.
*Attorney, Agent, or Firm*—Emrich & Dithmar

[57] ABSTRACT

A dual inline double acting plunger arrangement is particularly adapted for pumping thick slurries and includes a hollow cylinder divided into two closed chambers by a partition. A first plunger is disposed in a first chamber and a second plunger is disposed in a second chamber with the two plungers coupled together by appropriate linkage outside of the cylinder. A drive mechanism connected to the coupling linkage simultaneously displaces the two plungers in a reciprocating manner within the two chambers. Inlet and outlet ports in each of the chambers coupled to inlet and outlet valve assemblies allow for the pumping of a slurry from the chambers by the two plungers in an alternating manner. Each valve assembly includes a housing having a pair of ball valves which are both employed either as inlet valves or outlet valves, as the valve assembly may be configured to perform both functions. The valve assembly housing is comprised of a generally H-shaped unitary structure having a pair of couplers each adapted for connection to a chamber in the cylinder as well as a third coupler adapted for connection to either a source of the slurry or to an outlet for the slurry. The H-shaped housing includes two upper and two lower removable end caps which are each securely held in place by a locking pin for ease of installation and removal as well as to facilitate manufacture, disassembly and cleaning of the housing of any slurry residue. The inlet and outlet valve assemblies are also coupled to the hollow cylinder by locking pin and threaded coupler connections for ease of assembly and disassembly such as in the field to facilitate cleaning of the pump. The double acting plunger pump provides a smooth, continuous slurry output as well as increased pumping efficiency.

8 Claims, 2 Drawing Sheets

88a
90a
84
2
90b
88b
22
80a
80b
92a
92b
14
26
18
86a
86b
46
16
54
32a
52a
40
42
56
12
82
50
34
48
112a
112b
20
114a
116
114b
118b
36
28
10
14a
118a
110a
110b
32b
40a
120a
120b
32c
30
16a
124
2
122a
122b
24

10
22
88b
90b
14
44
18
24
112b
114b
128
118b
136
124
3
98
148
3
134
100
86b
126
135
80b
132
110b
133
140
130
72
74a
74
138
131
122b
76
60
150
84
92b
20
120b
104
14a
96
102
94

81a
80b
81b
90b
98
88b
83a
83b 146
142
90b
144

QUICK RELEASE INTERCHANGEABLE VALVE ARRANGEMENT FOR SLURRY PUMP SYSTEMS

FIELD OF THE INVENTION

This invention relates generally to displacement pumps for pumping liquids having a wide range of consistencies and is particularly directed to a dual inline double acting plunger-type of pump which is easily manufactured, assembled and cleaned.

BACKGROUND OF THE INVENTION

Pumps are used to displace materials which flow having a consistency ranging from that of water to thick slurries such as containing sand or comprised of a liquid cement. These latter types of pumps typically employ a plunger disposed in a cylinder, where the plunger is displaced in a reciprocating manner and the cylinder receives the slurry during the plunger instroke and discharges the slurry during plunger outstroke. This results in an irregular, discontinuous pumping action of the slurry which is displaced only during the outstroke of the plunger. Another concern in these types of pumps is in the cleaning of the slurry from the pump following use. Cleaning of the pump is generally necessary because the slurry is typically comprised of a material which "sets" clogging the pump and rendering it inoperative if a slurry residue remains after use of the pump. Prior approaches require the use of tools for the removal of various components of the pump prior to cleaning which is tedious and time consuming, particularly when done at a job site, or "in the field." Moreover, cleaning and clearing the pump after a slurry residue has been allowed to "set" substantially increases the difficulty of the task.

The present invention addresses the aforementioned problems encountered in the prior art by providing a dual inline double acting plunger arrangement for the pumping of slurries having a wide range of consistencies which is easily cleaned and maintained following use.

OBJECTS AND SUMMARY OF THE INVENTION

Accordingly, it is the object of the present invention to provide a displacement pump for liquids having a wide range of consistencies which provides a smooth, continuous flow at the outlet.

It is another object of the present invention to provide a dual inline double acting plunger-type pump for slurries which is easily assembled and disassembled such as for cleaning and the removal of slurry material which "sets" in solid form.

Yet another object of the present invention is to provide a dual inline double acting plunger-type pump for slurries having a unitary double valve housing for connection to both pump chambers which may be used interchangeably and without modification at either the pump's inlet or outlet ports.

This invention contemplates apparatus for pumping a slurry, the apparatus comprising a cylindrical hollow housing apparatus for pumping a slurry, the apparatus comprising: a cylindrical hollow housing having an inner partition forming first and second chambers in the housing, wherein each of the first and second chambers includes a respective input port and output port; first and second plungers respectively disposed in the first and second chambers; drive means for simultaneously displacing the first and second plungers in the first and second chambers in a reciprocating manner; an inlet valve housing having an inlet port coupled to a source of the slurry and first and second outlet ports respectively coupled to the first and second chambers for providing slurry thereto; and an outlet valve housing having first and second inlet ports respectively coupled to the first and second chambers for receiving slurry pumped therefrom, the outlet vane housing further including an outlet port for discharging the slurry, wherein the inlet and outlet housings are of substantially the same size and configuration and are interchangeable.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
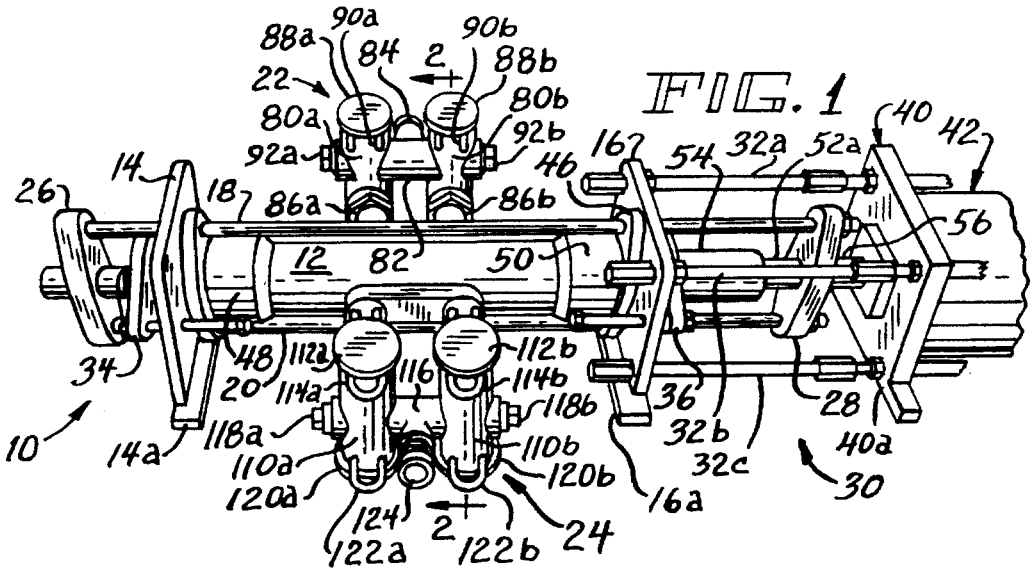
FIG. 1 is an upper perspective view of a dual inline double acting plunger-type slurry pump in accordance with the present invention.
Figure 2:
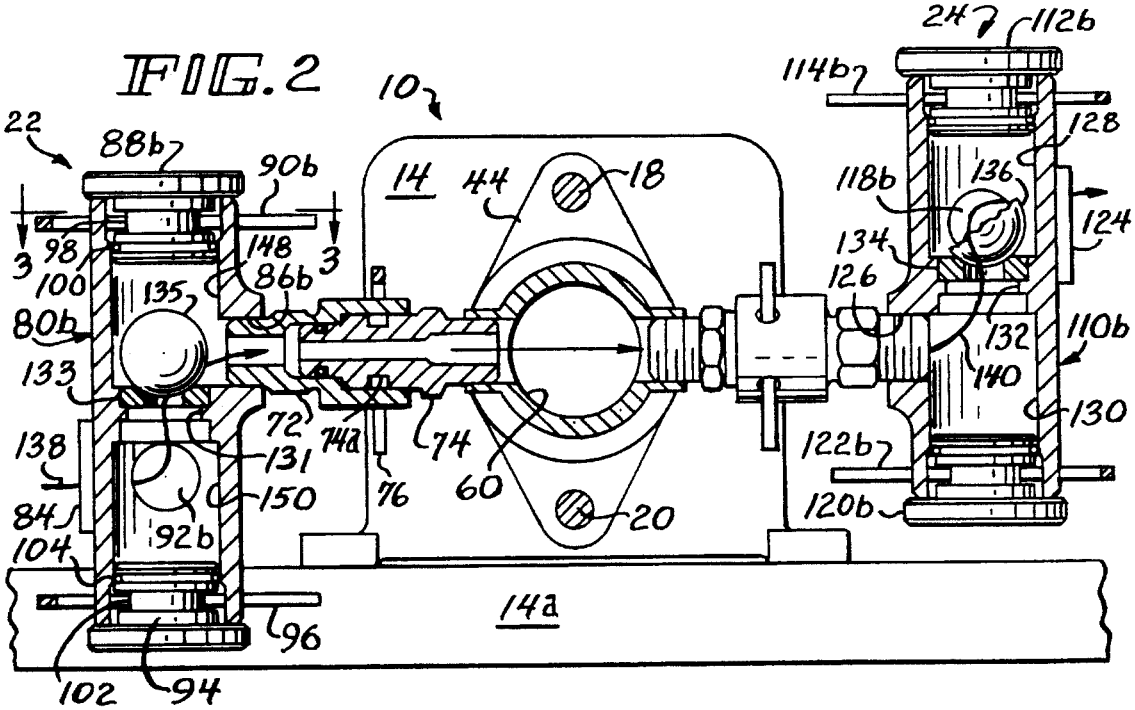
FIG. 2 is a transverse sectional view of the slurry pump of FIG. 1 taken along site line 2—2 therein.
Figure 5:
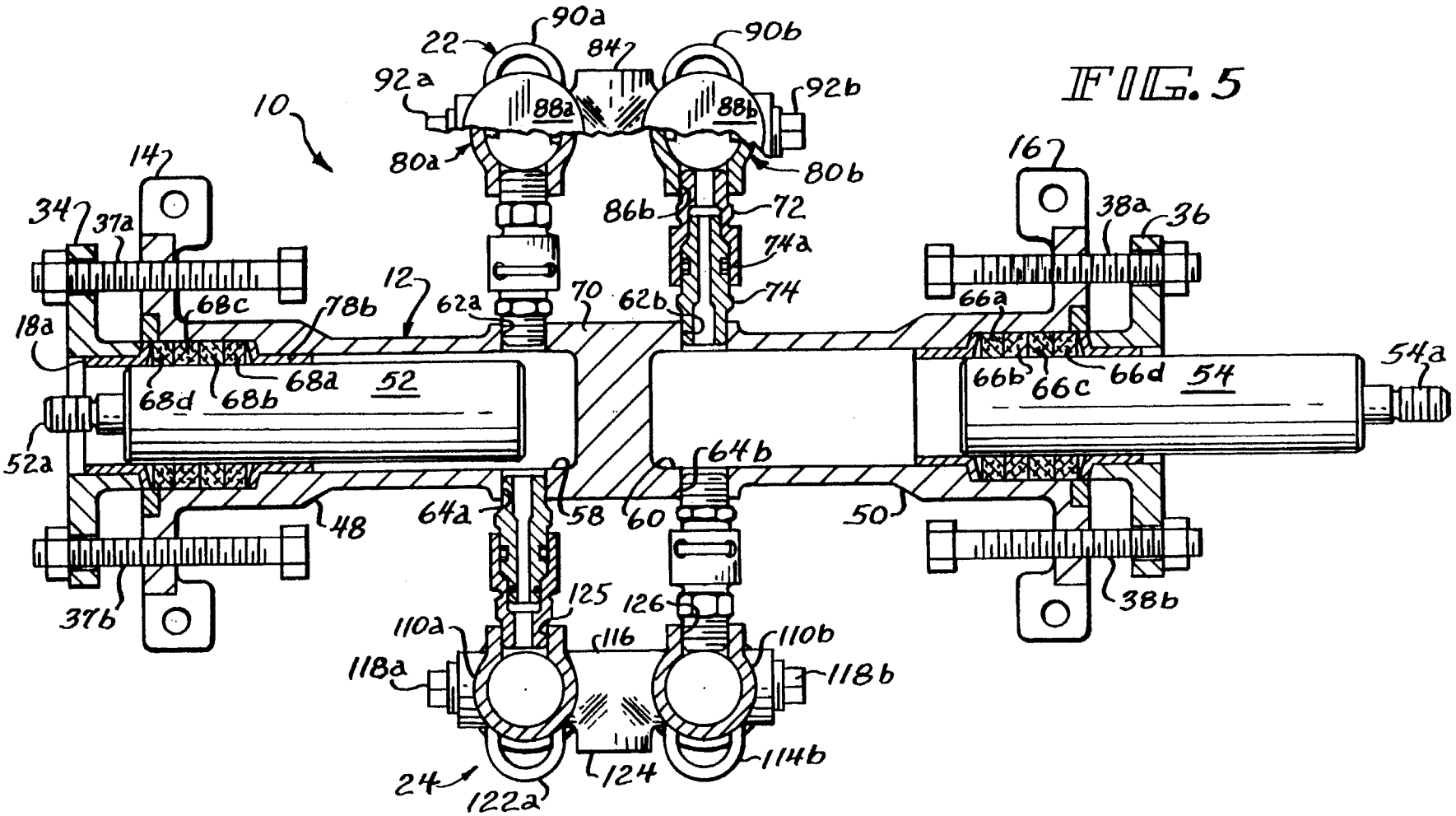
FIG. 5 is a longitudinal sectional view shown partially cut-away of a slurry pump in accordance with the present invention.

Referring to FIG. 1, there is shown an upper perspective view of a slurry pump 10 in accordance with the present invention. A transverse sectional view of the slurry pump 10 shown in FIG. 1 taken along site line 2—2 is shown in FIG. 2. FIG. 5 is a top plan view shown partially in section and partially cut-away of the slurry pump 10 of the present invention.

The slurry pump 10 includes a pump body 12 in the form of a cylindrical housing having first and second displacement chambers 58 and 60 separated by a partition, or wall, 70. Disposed in the first displacement chamber 58 is a first plunger 52, while disposed in the second displacement chamber 60 is a second plunger 54. Each of the plungers 52, 54 is freely moveable in a reciprocating manner within its respective displacement chamber. Disposed on a first end of the pump body 12 is a first end stuffing box with packing 48, while disposed on a second, opposed end of the pump body is a second end stuffing box with packing 50. Also disposed on the first end of the pump body 12 is the combination of a first end plate 14 and a support bracket or foot 14a. Similarly, disposed on the second, opposed end of the pump body 12 is the combination of a second end plate 16 and a support bracket or foot 16*a*. Inserted within the first end stuffing box 48 are a plurality of annular packings 68*a*, 68*b*, 68*c* and 68*d* as shown particularly in the sectional view of FIG. 5. Similarly, disposed within the second end stuffing box 50 are a second plurality of annular packings 66*a*, 66*b*, 66*c* and 66*d*. Each of the packings is disposed about its associated plunger in a tight fitting manner to form a seal between the pump body 12 and the moving plunger. On the first end of the pump body 12, the plunger packings 68*a*–68*d* are disposed between and in contact with first and second packing washers 78*a* and 78*b*. Packing washers 78*a*, 78*b* are also disposed in sealed contact with the first plunger 52 and pump body 12. A similar arrangement of plunger packings and packing washers is disposed at the second, opposed end of the pump body 12. Disposed in contact with the first packing washer 78*a* is a first packing gland 34 which is securely and adjustably attached to the first end plate 14 by means of a plurality of nut and bolt combinations 37*a* and 37*b*. Similarly, on the second end of the pump body 12 a second packing gland 36 is securely attached to the second end plate 16 by means of a plurality of nut and bolt combinations 38*a* and 38*b*. Each of the packing glands of 34, 36 maintains the combination of the plunger packings and packing washers in place within the pump body 12 to maintain a seal between the pump body and the first and second plungers 52 and 54. Thus, the first and second plungers 52, 54 may be displaced within and along the length of the first and second chambers 58, 60, respectively, with a slurry introduced into each of the chambers without the slurry leaking from the chamber where the plunger is inserted into the chamber.

As shown particularly in FIG. 5, each of the plungers 52 and 54 has a diameter so as to leave a clearance between the plunger and the respective displacement chambers 58 and 60. The substantial spacing between each pair of plungers and displacement chambers facilitates the reciprocating displacement of the plunger within the chamber even when pumping a thick slurry. Plunger displacement is facilitated by the flow of the slurry into the space or gap between the plunger and its associated displacement chamber.

Each of the first and second plungers 52, 54 has a respective threaded coupling attached to its outer end portion. Threaded coupler 52*a* of the first plunger 52 is attached to a first end yoke 26, while the threaded coupler 54*a* of the second plunger 54 is attached to a second end yoke 28. Coupling the first and second yokes 26, 28 are first and second traverse rods 18 and 20. The first and second traverse rods 18, 20 extend through apertures within and are freely slidable in the first and second end plates 14, 16 and first and second mounting brackets 44 and 46. The two plungers 52 and 54 are thus securely coupled together by means of the combination of yokes 26 and 28 and traverse rods 18 and 20. Displacement of one plunger will result in a corresponding displacement of the other plunger in the same direction and an equal distance.

Attached to the second end plate 16 by means of four attachment rods is a mounting plate 40. Three of the attachment rods are shown as elements 32a, 32b and 32c in FIG. 1. Appropriate end couplers are attached to each of the attachment rods for securely connecting second end plate 16 to mounting plate 40 in forming a rigid structure. Disposed on a lower portion of mounting plate 40 is a support bracket or foot 40*a*. Each of the lower support brackets provides for the secure and stable positioning of the slurry pump 10 on a flat support surface. Mounted to a second, opposed surface of mounting plate 40 is a reciprocating driver 42. Reciprocating driver 42 may be electrically, pneumatically or hydraulically actuated and may be conventional in design and operation. Reciprocating driver 42 is coupled to the second end yoke 28 by means of a connecting shaft 56. Driver 42 displaces the combination of the first and second end yokes 26, 28, the first and second traverse rods 18, 20, and the first and second plungers 52, 54.

In accordance with the present invention, attached to respective, opposed lateral portions of pump body 12 are an inlet valve assembly 22 and an outlet valve assembly 24. The inlet and outlet valve assemblies 22 and 24 are essentially identical in configuration and operation, but are employed in opposite vertical orientation, or one valve assembly is upside down relative to the other valve assembly as described below.

The inlet valve assembly 22 includes first and second generally cylindrical upright members 80*a* and 80*b* coupled by means of a cylindrical cross member 82. The first and second upright members 80*a*, 80*b* and the cross member 82 form a generally H-shaped structure which is hollow. Cross member 82 includes an inlet port 84 for receiving a slurry into the inlet valve assembly 22 from a slurry source which is not shown in the figures for simplicity. Respectively disposed on the upper ends of the upright members 80*a*, 80*b* are first and second top caps 88*a* and 88*b*, while disposed on the lower ends of these upright members are first and second bottom caps. Top caps 88*a*, 88*b* are securely maintained in position on the first and second upright members 80*a*, 80*b* by means of a first and second U-shaped locking pins 90*a* and 90*b*, respectively, as described below. A similar pair of U-shaped locking pins securely maintains the bottom caps on the lower ends of the upright members 80*a*, 80*b*. Threadably inserted in and attached to respective lateral apertures in the first and second upright members 80*a*, 80*b* are first and second side caps 92*a* and 92*b*. The top and bottom caps as well as each of the side caps 92*a*, 92*b* are easily removed from the inlet valve assembly 22 to facilitate cleaning of the valve assembly after use. This is particularly important where a slurry of a "setable" material is pumped and the pump is not cleaned immediately after use. The material for which this pump is designed has a tendency to precipitate. The presence of a precipitate dictates that the pump be cleaned after each use as the precipitate will collect in various portions of the valve assembly, particularly in the area of the valve ball and its associated flow channel interfering with proper seating of the ball, resulting in reduced pumping pressure. The present invention permits complete disassembly of the valve assemblies and facilitates valve assembly cleaning to the point where it can be easily accomplished after every use.

The outlet valve assembly 24 similarly includes first and second upright members 110*a* and 110*b*. Disposed on the respective upper ends of the first and second upright members 110*a*, 110*b* are first and second top caps 112*a* and 112*b*. Disposed on the respective lower ends of the first and second upright members 110*a*, 110*b* are first and second bottom caps 120*a* and 120*b*. Top caps 112*a* and 112*b* are securely attached to the upright members by means of respective locking pins 114*a* and 114*b*, while bottom caps 120*a*, 120*b* are securely attached to the respective lower ends of the upright members by locking pins 122*a* and 122*b*. The first and second upright members 110*a*, 110*b* are connected by means of a hollow cross member 116 which includes an outlet port 124. Inserted in and threadably connected to the first and second upright members 110*a*, 110*b* of the outlet valve assembly 24 are first and second side caps 118*a* and 118*b*. As in the case of the inlet valve assembly 22, the upright members of 110*a*, 110*b* and cross member 116 of the outlet valve assembly 24 are hollow permitting a slurry to enter the valve assembly by means of first and second inlet ports 125 and 126 and to exit via the outlet port 124.

The connection between the second upright member 80*b* of the inlet valve assembly 22 to the pump body 12 will now be described. The connections between the other upright member 80*a* of the inlet valve assembly 22 and the pair of upright members 110*a* and 110*b* of the outlet valve assembly 24 to the pump body 12 are identical to the connection between the inlet valve assembly's second upright member 80*b* and the pump body and are therefore not described in detail herein. The connection between the inlet valve assembly's second upright member 80*a* and the pump body 12 includes a first female threaded connector 72 and a second male threaded connector 74. The first female connector 72 is inserted in and threadably engages an outlet port 86*b* in the inlet valve assembly 22. Similarly, the second male connector 74 is inserted in and threadably engages an inlet port 62*b* in a lateral portion of the pump body 12. The opposite end of the second male connector 74 is adapted for insertion in a second end of the first female connector 72. An outer portion of the second male connector 74 includes an annular slot 74*a* disposed about the periphery thereof. Annular slot 74*a* in the second male connector 74 is adapted to receive a U-shaped locking pin 76. Locking pin 76 is inserted through two pairs of aligned apertures within the first female connector 72 as described below.

With reference specifically to FIG. 2, the operation of the inlet and outlet vane assemblies 22 and 24 will now be described. Each of the upright members in the inlet and outlet valve assemblies 22, 24 includes a respective ball. Thus, upright member 80*b* of the inlet valve assembly 22 includes ball 135, while upright member 110*b* of the outlet valve assembly 24 includes ball 136 as shown in FIG. 2. Each of the upright members includes an upper and lower chamber. Thus, upright member 80*b* includes upper and lower chambers 148 and 150, while upright member 110*b* includes upper and lower chambers 128 and 130. Separating the upper and lower chambers in each upright member is a respective reduced flow channel. Thus, in upright member 80*b*, reduced flow channel 131 separates the upper and lower chambers 148 and 150. Similarly, reduced flow channel 132 in upright member 110*b* separates the upper and lower chambers 128 and 130 therein. In each valve assembly, the ball is disposed in an upper chamber of a respective upright member. Also disposed in the lower portion of the upper chamber is a valve seat which is adapted for mating engagement with its associated ball. Thus, valve seat 133 which includes an aperture therein is disposed in upper chamber 148 and is adapted for engagement with ball 135. Similarly, valve seat 134 is disposed in upper chamber 128 is adapted for engagement with ball 136. The ball must be positioned in the upper chamber of an upright member for proper operation of the valve assembly.

Disposed immediately above and below each of the reduced flow channels 131 and 132 are upper and lower valve seat pockets, or recesses. Each recess is adapted to receive a valve seat which, in turn, is adapted to receive a valve ball. The upper and lower recesses are each adapted to receive the valve seat and valve ball combination permitting the valve housing to be used with either of its chambers positioned as either the upper chamber or the lower chamber. Interchangeable use of the valve housing in both vertical orientations permits reversal of valve housing functions from inlet to outlet and vice versa, resulting in more even distribution of wear, thus substantially prolonging the lifetime of the pump.

In operation, a slurry is introduced into the inlet port 84 of the inlet valve assembly 22 in the direction of arrow 138 in FIG. 2. The slurry flows from the lower chamber 150 into the upper chamber 148 and the reduced flow channel 131 by forcing the ball 135 upwardly. The slurry then flows via the pair of outlet ports 86*a* and 86*b* via the combinations of threaded connectors into the first and second displacement chambers 58, 60 via inlet ports 62*a* and 62*b*, respectively. Displacement of one of the plungers toward partition 70 forces slurry within that displacement chamber out of one of the outlet ports in the pump body 12. Thus, inward displacement of the first plunger 52 forces slurry out of the output port 64*a*, while at the same time outward displacement of the second plunger 54 draws slurry into the second displacement chamber 60 via inlet port 62*b*. This is followed by inward displacement of the second plunger 54 forcing slurry out of the second displacement chamber 60 via outlet port 64*b*, while at the same time the outward displacement of the first plunger 52 draws slurry into the first displacement chamber 58 via inlet port 62*a*. As shown in the FIG. 5, the slurry flows into outlet valve assembly 24 via inlet ports 125 and 126. The slurry flows into the lower chambers, such as shown for lower chamber 130, in the outlet valve assembly 24 and thence into the upper chambers, such as shown for upper chamber 128 in FIG. 2. As in the inlet valve assembly 22, the paired upper and lower chambers 128, 130 in each of the upright members of the outlet valve assembly 24 are connected by means of a reduced flow channel 132 above which is disposed a valve seat gasket 134 for receiving ball 136. Inward flow of slurry into the lower chamber 130 forces ball 136 upwardly, permitting the slurry to flow into the upper chamber 128 and to exit the outlet valve assembly 24 via outlet port 124. As shown in FIG. 2, the valve balls are always located in an upper chamber and the inlet and outlet valve assemblies 22, 24 are identical in size and configuration and are merely reversed in vertical orientation, with the outlet valve assembly upside down relative to the inlet valve assembly. From FIG. 2, it can also be seen that the upper and lower chambers in each of the inlet and outlet valve assemblies 22, 24 are provided with recesses adjacent the reduced flow channels 131 and 132 for receiving the valve seat gaskets 133 and 134 in either vertical orientation of the valve assembly, i.e., with either the first displacement chamber disposed above the second displacement chamber or visa versa.

Figure 3:
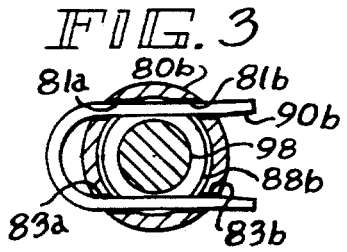
FIG. 3 is a sectional view of a portion of a valve housing employed in the slurry pump of FIG. 2 taken along site line 3—3 therein.
Figure 4:
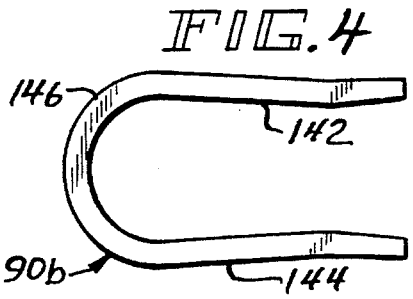
FIG. 4 is an elevation view of a generally U-shaped locking pin for attaching an end cap to the valve housing shown in FIG. 2 in a manner which facilitates removal of the end cap such as for cleaning the pump.

Referring to FIG. 3, there is shown a sectional view of a portion of the second upright member 80*b* of the inlet valve assembly shown in FIG. 2 taken along site line 3—3 therein. Top cap 88*b* is inserted in the open upper end of upright member 80*b*. Top cap 88*b* includes a peripheral recess 98 disposed about the periphery thereof. The second upright member 80*b* includes a first pair of aligned apertures 81*a* and 81*b* and a second pair of aligned apertures 83*a* and 83*b* adapted for receiving a generally U-shaped locking pin 90*b*. In elevation view of locking pin 90*b* is shown in FIG. 4. Locking pin 90*b* includes first and second straight end portions 142 and 144 and a curvilinear intermediate portion 146. The aligned apertures in each of the upright members securely maintains a locking pin in position within the valve assembly and the locking pin itself engages and securely maintains a respective top or bottom cap on the open end of an upright member. An O-ring 100 attached to an inner end portion of the top or bottom cap forms a seal between the cap and the inner surface of the upright member.

There is thus been shown a slurry pump which includes a cylindrical housing formed into first and second chambers in each of which is disposed a moveable plunger. The two plungers are coupled together and are further connected to and displaced by a drive arrangement to allow the plungers to simultaneously move in a reciprocating manner within the displacement chambers. An inlet valve assembly provides a slurry to both displacement chambers, while an outlet valve assembly provides for the discharge of the slurry by the pumping action of the two plungers. The slurry is introduced into one chamber while being discharged from the other chamber to provide for a smooth, continuous flow of the slurry from the pump. Each of the inlet and outlet valve assemblies includes a pair of ball valves for either introducing slurry into the displacement chambers or for allowing for outward flow of the slurry from the two chambers, while preventing backflow of the slurry. The inlet and outlet valve assemblies employ a common unitary housing which are interchangeable between the inlet and outlet sides of the pump body. Easily removed retaining pins connect each of the valve assemblies to the pump body which facilitate disconnection of the valve assembly from the pump body for cleaning the valve assembly. Each of the valve assemblies further includes upper and lower end caps securely maintained in position by retaining pins which also are easily removed to facilitate valve assembly cleaning such as after pumping a setable slurry material. The slurry pump is easily assembled and disassembled in the field which facilitates cleaning the pump and valve assemblies under adverse conditions such as at a job site.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for pumping a slurry, said apparatus comprising:

a cylindrical hollow housing having an inner partition forming first and second chambers in said housing, wherein each of said first and second chambers includes a respective input port and output port;

first and second plungers respectively disposed in said first and second chambers;

drive means for simultaneously displacing said first and second plungers in said first and second chambers in a reciprocating manner;

an inlet valve housing having an inlet port coupled to a source of the slurry and first and second outlet ports respectively coupled to said first and second chambers for providing slurry thereto;

an outlet valve housing having first and second inlet ports respectively coupled to said first and second chambers for receiving slurry pumped therefrom, said outlet valve housing further including an outlet port for discharging the slurry, wherein said inlet and outlet housings are of substantially the same size and configuration and are interchangeable, wherein each of said interchangeable inlet and outlet valve housings includes first and second hollow members coupled together by means of a third hollow cross member, and wherein said first, second and third members form a unitary housing; and first and second coupling means for connecting said first and second hollow members of each of said valve housings to said first and second chambers, respectively, wherein each of said first and second coupling means includes a male and female connector combination coupled to said cylindrical housing and to a first or second hollow member, and a generally U-shaped locking pin coupling said male and female connectors to facilitate removal and cleaning of said valve housings.

2. The apparatus of claim 1 wherein said female connector includes a plurality of apertures for receiving said locking pin and said male connector includes an outer peripheral slot for receiving said locking pin.

3. The apparatus of claim 1 wherein each of said first and second hollow members includes an upper and a lower chamber and a ball valve disposed intermediate and connecting said upper and lower chambers.

4. The apparatus of claim 3 wherein each of said inlet and outlet valve housings further includes top and bottom caps attached to each of said first and second hollow members by means of said locking pin to facilitate cleaning of said valve housing.

5. The apparatus of claim 4 wherein each of said first and second hollow members further includes a ball and valve seat combination, wherein said ball is disposed in an upper chamber of a hollow member and wherein each of said upper and lower chambers includes a respective recess for receiving said valve seat to permit said hollow members to be used in either an upright or an inverted orientation.

6. The apparatus of claim 4 wherein opposed ends of each of said first and second hollow members includes a plurality of apertures and each of said caps includes an outer peripheral slot for receiving said locking pin.

7. The apparatus of claim 6 wherein each of said first and second hollow members further includes a removeable side plug to facilitate cleaning of said valve housing.

8. The apparatus of claim 7 further comprising a threaded coupling connecting each side plug to its associated hollow member.

* * * * *